US006290097B1

(12) United States Patent
Oakley

(10) Patent No.: US 6,290,097 B1
(45) Date of Patent: Sep. 18, 2001

(54) VISCOUS LIQUID COMPOSITION SUPPLY SYSTEM

(75) Inventor: Brett Oakley, Middletown, OH (US)

(73) Assignee: Mar-Flex Systems, Inc., Middletown, OH (US)

( * ) Notice: Subject to any disclaimer, the term of this patent is extended or adjusted under 35 U.S.C. 154(b) by 0 days.

(21) Appl. No.: 09/596,123

(22) Filed: Jun. 16, 2000

(51) Int. Cl.[7] ..... B67B 7/00
(52) U.S. Cl. ..... 222/1; 222/146
(58) Field of Search ..... 222/1, 146; 126/26

(56) References Cited

U.S. PATENT DOCUMENTS 3,561,645 * 2/1971 Hopkins ..... 222/146
3,841,527 * 10/1974 Von Roeschlaub ..... 222/146
4,443,909 4/1984 Cameron .
4,527,712 * 7/1985 Cobbs, Jr. et al. ..... 222/1
4,576,122 * 3/1986 Marcato ..... 126/26
5,983,990 * 11/1999 Alvarez ..... 222/1

* cited by examiner

*Primary Examiner*—Philippe Derakshani
*Assistant Examiner*—Thach H Bui
(74) *Attorney, Agent, or Firm*—Biebel & French

(57) ABSTRACT

A mobile supply apparatus for supplying heated waterproofing composition to a remote work site and a method of operating the apparatus are disclosed. Heat exchange fluid from the motor vehicle's cooling system is used to heat the waterproofing composition in the reservoir of the supply apparatus and in a separate direct heat exchange unit provided in the reservoir. Heated waterproofing composition can be applied to the work site or recirculated through the waterproofing composition supply system so as to preheat applicator devices such as hoses and nozzles.

20 Claims, 4 Drawing Sheets

VISCOUS LIQUID COMPOSITION SUPPLY SYSTEM

FIELD OF THE INVENTION

The invention relates to a mobile supply apparatus for delivering a viscous composition, such as a waterproofing composition to a work site and to methods of supplying such compositions to those work sites.

BACKGROUND OF THE INVENTION

The demand for application of waterproofing compositions to structural foundations such as residential and commercial buildings has increased dramatically over the last few years. Typically, these compositions comprise a viscous fluid containing elastomeric components in either an organic solvent or water base. These viscous compositions must be heated prior to application at the work site so that they will flow readily through the supply equipment and then, after application, dry to provide an elastomeric or rubbery waterproofing coating over the desired substrate.

Typically, the water proofing compositions are sprayed on the building foundation or other substrate by a hose and associated spray nozzle. The hoses and associated spray mechanisms are often plugged by deposition therein of hardened viscous masses of the composition.

It is therefore desirable to provide a mobile supply apparatus and system for carrying a sufficient quantity of waterproofing composition to the job site. It is even more desirable that the apparatus provide for on-site heating of the waterproofing composition so as to provide for lowered viscosity and commensurate improved fluid flow characteristics through the spray equipment.

It is even more desired to provide such a mobile supply apparatus wherein the hose and/or other composition applicator means may be heated prior to application of the waterproofing composition to the work site so as to soften and fluidize hardened masses within the hose or applicator.

SUMMARY OF THE INVENTION

These and other objects of the invention are met by the apparatus and method disclosed herein. Basically, the apparatus comprises a housing member that can be lifted via a forklift or hoist onto the flatbed of a truck or other motor vehicle. An insulated reservoir is provided in the housing for receipt of a sufficient quantity, such as greater than about 100 gallons, of the waterproofing composition therein.

A supply conduit is in fluid communication with the reservoir and is operatively associated with a pump so as to pump waterproofing composition from an upstream direction in the reservoir to a downstream direction through the hose and spray nozzle for application to the desired substrate. A heat exchanger is in fluid communication with the supply conduit and is adapted for flow of the waterproofing composition therethrough. Heat exchange fluid from the cooling system of the motor vehicle is forwarded to the heat exchanger in heat exchange relationship with the waterproofing composition. A valve is provided to readily connect the circulating heat exchange fluid from the cooling system of the vehicle to the heat exchanger.

The coolant or heat exchange fluid from the motor vehicle may also be first forwarded to a direct heating circuit through a heat exchanger coil located in the reservoir itself. This helps to soften and fluidize gel or gummy masses of the composition that have settled in the reservoir.

A hose or other applicator device is connected to the supply line downstream from the heat exchanger and is utilized to apply heated waterproofing composition to the required job site. The application or downstream end of the hose may be connected to a recycle conduit for recycling of heated waterproofing composition back into the reservoir. By utilization of the recirculation feature of the invention, the hose or other applicator can be pre-heated, prior to usage, by recirculation of heated waterproofing composition therethrough so that application of the waterproofing composition to the substrate can be substantially unimpeded through the hose or applicator device.

In another aspect of the invention, the housing is provided with an access compartment having a thermally conductive wall member contiguously bordering the reservoir. The hose or other applicator and the heat exchanger may be mounted in this compartment along the common wall or border. Accordingly, the heat from the heated waterproofing composition disposed in the reservoir acts to provide further heat via conduction or convection to the hose or applicator through this wall member. Further, due to location of the heat exchanger in close proximity to the hose or other applicator within the compartment, the heat exchanger itself provides heat, normally via convection to the applicator.

The housing further comprises a lift mounting receptacle such as pair of feet which are adapted for receipt of a forklift therein so that the entire unit may be readily lifted in or out of the motor vehicle.

In accordance with the method, a quantity of waterproofing composition is placed into the reservoir and is forwarded to the heat exchanger which, as aforementioned, is provided with the heat exchange fluid from the motor vehicle to thereby heat the waterproofing composition. The heated waterproofing composition from the heat exchanger is then pumped to a supply conduit wherein it may be selectively supplied to the work site or recirculated back into the reservoir.

Cooling water from the motor vehicle is used as the heat exchange fluid. It is first supplied to a valved, direct heating fluid circuit where it passes through heat exchange coils disposed in the reservoir. Next, the cooling fluid is forwarded to the previously described heat exchanger to again heat the waterproofing composition flowing therethrough. The heat exchange fluid is recirculated back to the cooling system of the motor vehicle.

The invention will be further described in conjunction with the appended drawings and following detailed description. dr

DETAILED DESCRIPTION OF THE PREFERRED EMBODIMENT

Figure 1:
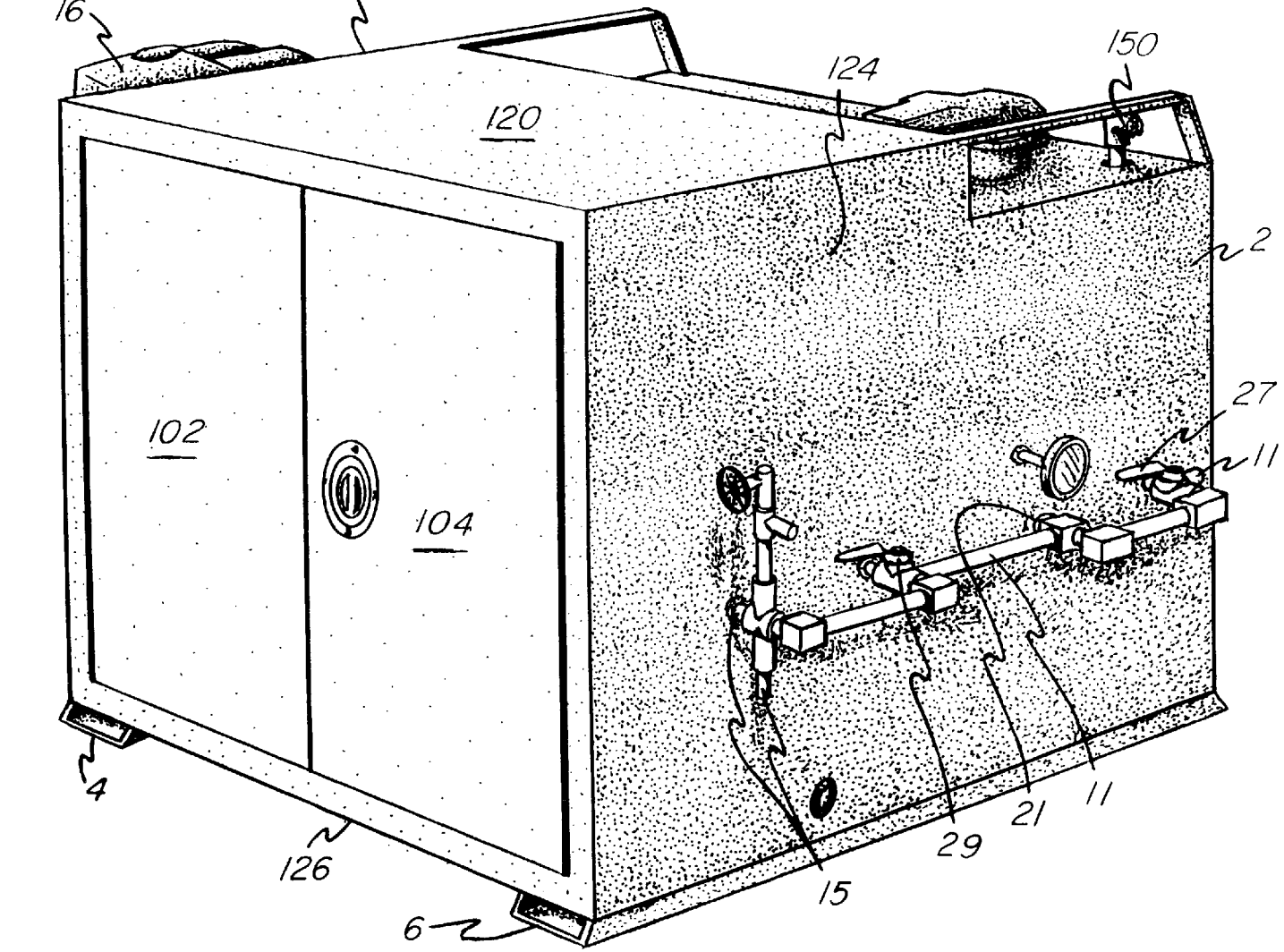
FIG. 1 is a perspective view of a mobile supply apparatus in accordance with the invention.
Figure 4:
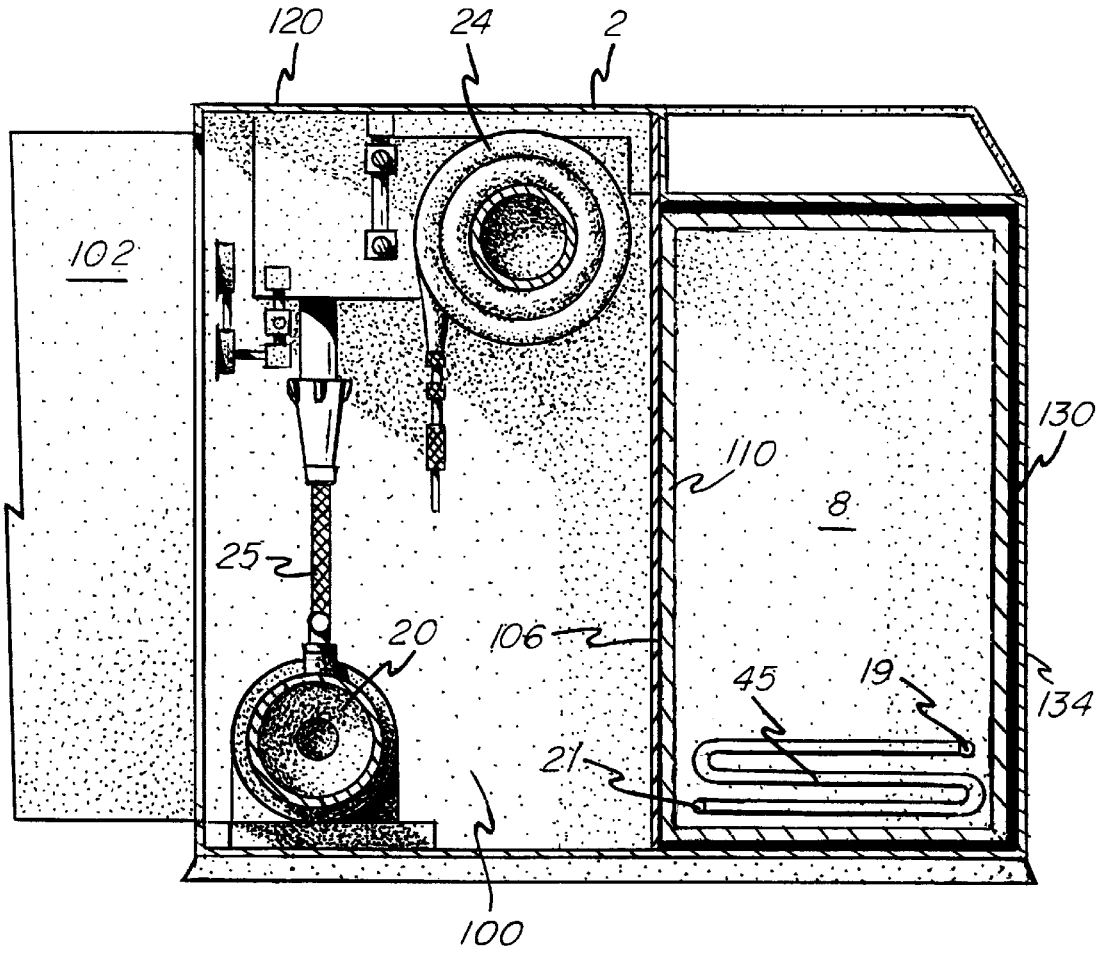
FIG. 4 is a sectional view of the apparatus shown in FIGS. 1 and 3 taken along the plane represented by the lines and arrows 4—4 in FIG. 3.

Turning first to FIGS. 1 and 4 of the drawings, there is shown housing member 2 which, in accordance with the preferred embodiment, is of a generally cuboid shape. The housing includes an insulated reservoir member 8 (FIG. 4) disposed therein which reservoir is adapted for receipt of greater than about 100 gallons of waterproofing composition thereof. As shown best in FIG. 1, mounting legs 4, 6, are provided beneath the housing and are adapted for receipt of the prongs or tines from a forklift so that the entire assembly may be lifted onto and off of the desired motor vehicle.

Figure 2:
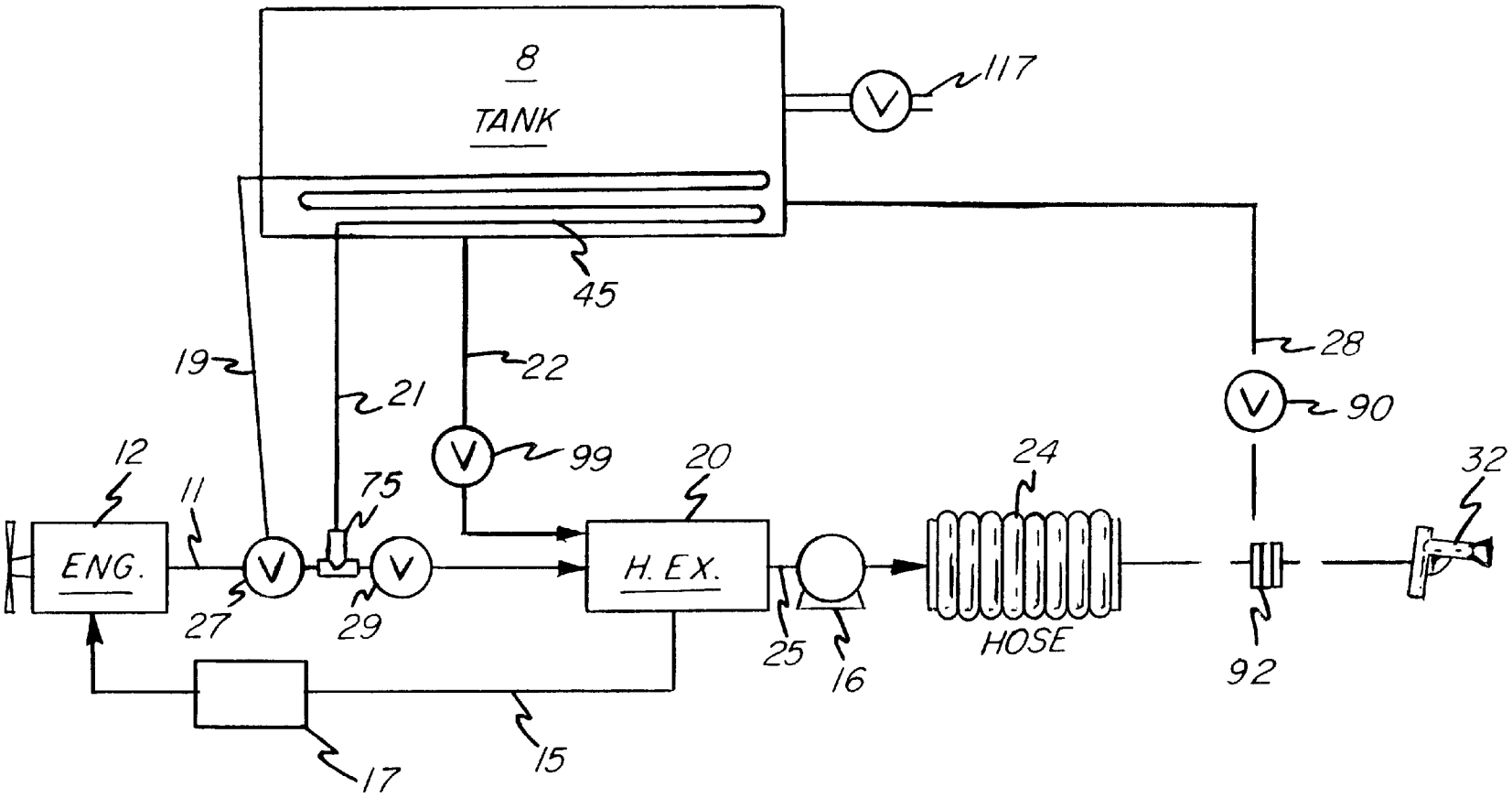
FIG. 2 is a schematic diagram showing the flow of waterproofing composition and heat exchange fluid.

As shown in FIG. 2, the motor vehicle is provided with an engine 12 and heat exchange fluid supply line 11 and return line 15 for returning the heat exchange fluid to the engine block through the radiator 17 of the vehicle. Heat exchange fluid is supplied to the heat exchanger 20 through valve member 29.

Pump 16 supplies pressurized flow of waterproofing composition from the reservoir 8 through valve 99 and the heat exchanger 20 via line 22 and line 25. The heat exchanger may be any of the conventional types normally employed in industry. However, it is presently preferred to use a tube and shell type heat exchanger.

The waterproofing composition is supplied via supply line 22 to the heat exchanger and then to the applicator hose assembly 24 through line 25. Downstream from the hose assembly, a quick fit connector 92 and valve 90 are provided to selectively permit application of heated waterproofing composition through the hose and applicator nozzle 32 or alternatively the waterproofing composition can be recirculated to the reservoir via connection to the return line 28 as permitted by the valve 90.

Recirculation of the waterproofing composition through the reservoir allows for a pre-heating of the hose 24 or other applicator. In practice, this has provided advantage since deposits may form in the hose which would otherwise impede even, uniform application of the composition to the desired substrate. Accordingly, the operator, preferably utilizes this recirculation feature to allow for proper preheating of the hose before applying the material to the desired substrate.

As shown, the apparatus comprises a direct heating system upstream from the heat exchanger 20 that provides for in reservoir heating by the heat exchange fluid from the motor vehicle. This has proven effective in softening and fluidizing the gel like agglomerates that can form in the bottom of the reservoir. Here in this direct heating pass, heat exchange medium is forwarded to the tank 8 through three-way valve 27 and supply inlet conduit 19.

Conduit 19 communicates with serpentine heat exchange coils 45 disposed along the bottom of the reservoir. Heat exchange fluid returns to the conduit 11 through return conduit 21 which communicates with supply line 11 downstream from valve 27 as shown at "T" fitting 75. An auxiliary valved inlet 117 is provided in conjunction with the reservoir so that additional tanks or reservoirs containing waterproofing composition can be connected to the reservoir 8 to, in effect, increase the fluid capacity of the system.

Flow of the heat exchange fluid to heat exchange 20 is regulated by valve 29. The heat exchanger, as shown, is located on the suction side of the pump 16. The pump used at present provides for a fluid flow rate of about 3–5 gallons per minute and provides a pressure of about 2,500–4,000 psi. Graco, model 7900, gas driven pump having 5½ h.p. is presently used.

The waterproofing compositions utilized in accordance with the invention are normally composed of an elastomeric polymer component in an organic base such as toluene or hexane or, the waterproofing composition can be provided in the form of a water based latex emulsion. Typically, these compositions have viscosities of 2,000 to 6,000 cps at 70° F., and must be heated to temperatures of 85 to about 130° F., to provide for desired flow properties that result in an even, uniform distribution over the desired substrate, such as the foundation of a residential or commercial building.

Exemplary waterproofing compositions may comprise for example, liquid components, such as heavy napthenic distillates, hexane, toluene, heptane etc. which function as carrier liquids or solvents for elastomeric polymers such as polystyrene/polyisoprene copolymers; polystyrene/polyisoprene/polystyrene terpolymers; polystyrene/polybutadiene block polymers, etc. Conventional tackifying agents and pigments may also be present in the waterproofing compositions. Water based waterproofing compositions such as those based on the polyacrylates and poly(meth) acrylate latexes can also be mentioned.

Figure 3:
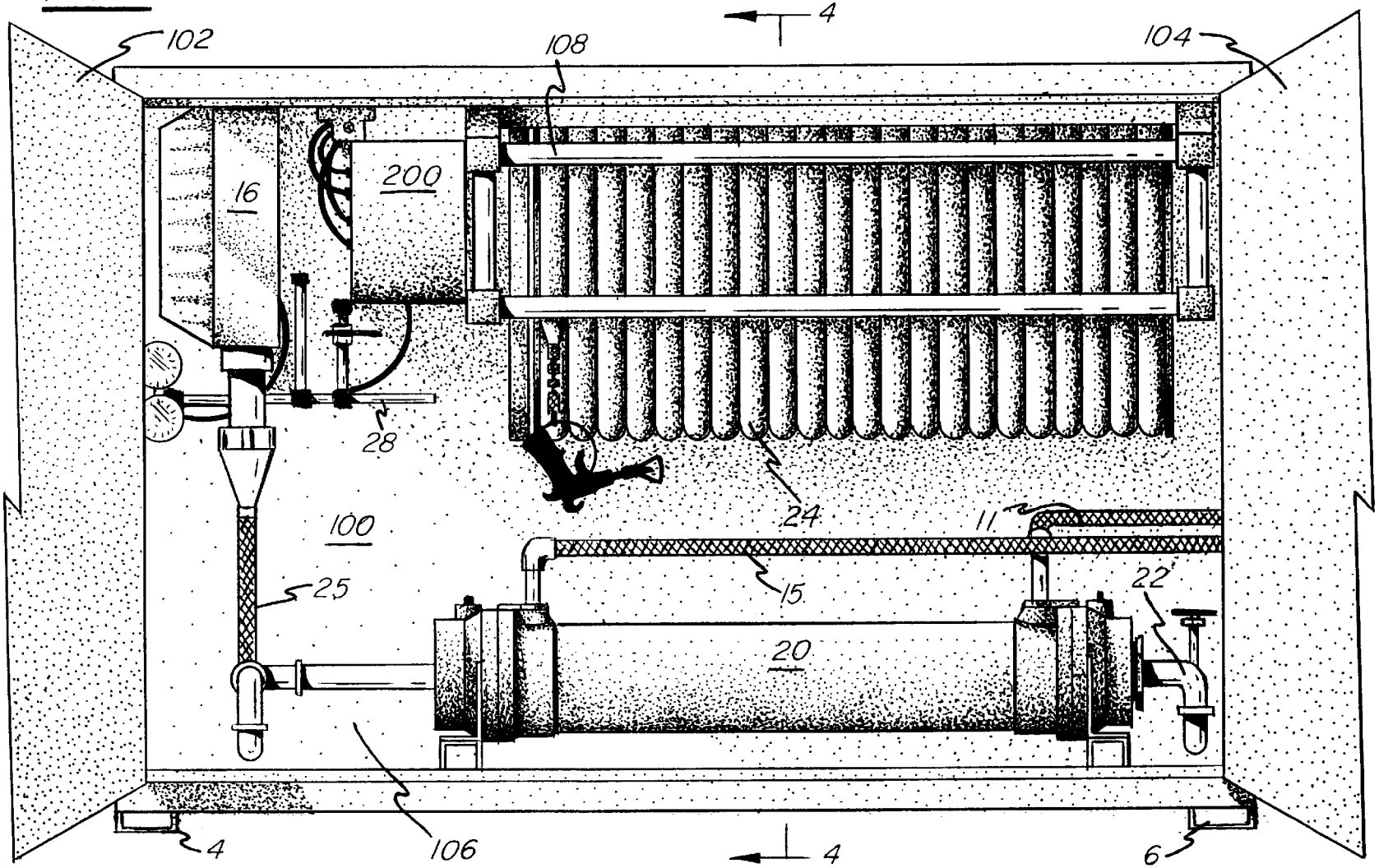
FIG. 3 is a front elevational view of the apparatus of FIG. 1, with the access doors broken away for increased clarity.

Turning now to FIGS. 1, 3 and 4 of the drawings, the housing includes compartment 100 with access doors 102, 104 allowing access to the compartment. At the rear end of the compartment 100 a wall member 106 (FIG. 3) is provided that is contiguous with the bordering area 110 of the reservoir enclosed by the housing (FIG. 4).

As shown, electrically powered reel member 108 (FIG. 3) provides a ready mount for the hose member and is provided adjacent the wall 106. The automatic reel is available from Hanney Reels and provides for a 90° pivot of the reel and a driven rewind function. Mounting of the reel and hose proximate the wall 106 of the compartment 100 allows for conduction heating of the hose by heated material in the reservoir. The rewind feature of the reel is controlled via motor 200.

As can be best seen in FIGS. 1 and 4, the housing comprises a top member 120, left hand side 122, right hand side housing 124, a bottom 126, a front comprising the access doors and a rear wall 134 (FIG. 4). Insulation 130 (FIG. 4) is provided substantially around the reservoir between the reservoir and the housing. However, substantially no insulation is provided along the portion of the reservoir bordering the front wall 106 so as to improve heat conduction through the wall 106 as referred to above. A quick connect entry inlet 150 (FIG. 1) is provided in the top housing 120 to provide for filling of the reservoir with desired waterproofing composition.

In operation, the supply unit is first lifted onto the desired flat bed or similar surface of a motor vehicle. Sufficient quantity of waterproofing composition is then admitted to the reservoir via inlet 150. The supply apparatus is then driven to the desired work site.

At the work site, the cooling system of the vehicle is connected via a quick connect fitting to the supply line 11 of the heat exchange medium fluid circuit. The operator may then open valves 27 and 29 so that the heat exchange medium will flow respectively through the reservoir heating system and into the heat exchanger.

The pump means draws waterproofing composition from the reservoir 8 through supply line 22 into the heat exchanger wherein it is further heated. Return of the heating exchange fluid through return line 15 and radiator 17 is controlled by a pump (not shown) associated with the engine 12.

Heated waterproofing composition is drawn through supply line 25 via the action of the pump 16. In normal start up operation the quick connect fitting 92 connects the downstream end of the hose with the line 28 so that heated waterproofing composition may be recirculated through the tank, heat exchanger and the hose. Once the waterproofing composition has attained the requisite temperature, the quick connect fitting 92 to the line 28 is interrupted and the fitting 92 is connected to applicator gun 32 so that the waterproofing composition can then be sprayed through the hose member to the desired substrate.

It is apparent then that the present invention provides significant advantage in that a single unit is provided that can be readily placed in the flatbed of a truck or other motor vehicle. Heat exchange fluid from the vehicle cooling system is used selectively to first flow through the heat exchange coils in the reservoir and then through a heat exchanger to heat the waterproofing composition pumped from the tank through the heat exchanger. The heated waterproofing composition can, if desired, be recirculated back into the reservoir so as to provide by itself, as a heating medium to loosen or fluidize deposits which may form in the hose or other applicator.

Although the application primarily refers to utilization of the methods and apparatus in conjunction with viscous waterproofing compositions, the artisan will appreciate the fact that the invention can be used with other viscous liquids such as fence and deck coatings, driveway coatings, roofing compositions, paints, etc.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A method for delivering a viscous composition to a desired work site comprising:

(a) placing a quantity of said composition into a reservoir of a mobile supply apparatus adapted for mounting on a motor vehicle of the type having a cooling system with circulating heat exchange fluid therein;

(b) providing a heat exchanger;

(c) forwarding said heat exchange fluid and said composition to said heat exchanger in heat exchanger relation to each other to thereby heat said composition; and (d) forwarding said heated composition from said step (c) to a supply conduit and selectively (i) supplying said heated composition to said work site, or (ii) recirculating said heated composition back into said reservoir.

2. Method as recited in claim 1, wherein said supply conduit comprises a hose mounted on said mobile supply apparatus and wherein said step (d) (ii) comprises recirculating heated composition from said reservoir through said hose to heat and decrease viscosity of hardened masses of said composition deposited therein.

3. Method as recited in claim 2 further comprising the step of providing a pump in fluid connection with said reservoir, said heat exchanger and said supply conduit to provide pressurized flow of said composition from said reservoir through said heat exchanger and said supply conduit.

4. A method as recited in claim 1 further comprising, after said step, (c) returning said heat exchange fluid to said cooling system of said motor vehicle.

5. A method as recited in claim 2 further comprising mounting said hose adjacent said reservoir for heating of said hose by heated composition contained in said reservoir.

6. A method as recited in claim 2 further comprising mounting said heat exchanger on said mobile supply apparatus and mounting said hose proximate said heat exchanger for heating of said hose from said heat exchanger.

7. Method as recited in claim 1 further comprising forwarding said heat exchange fluid through a heat exchange located in said reservoir.

8. A mobile supply apparatus adapted for mounting on a motor vehicle of the type having a cooling system with circulating heat exchange fluid therein adapted to cool said motor, said apparatus adapted for heating and supplying a viscous composition to a desired work site, said apparatus comprising:

(a) a housing;

(b) a reservoir inside said housing and adapted to receive a quantity of said composition therein;

(c) a supply conduit connected to said reservoir and adapted for carrying pressurized flow of said composition therein;

(d) a heat exchanger in fluid connection with said supply conduit and said cooling system of said motor vehicle to heat said composition;

(e) a return conduit connecting said supply conduit to said reservoir; and (f) a valve communicating with said supply conduit and said return conduct for allowing selective (i) forwarding of said heated composition to said work site, or (ii) recirculating said heated composition back to said reservoir through said return conduit.

9. A mobile supply apparatus as recited in claim 8 further comprising a pump connected to said supply conduit.

10. A mobile supply apparatus as recited in claim 9 further comprising a hose connected to said supply conduit.

11. A mobile supply apparatus as recited in claim 10 wherein said housing comprises a compartment with a door attached to said housing and providing access to said compartment, said compartment having at least one wall bordering said reservoir, said hose and said heat exchanger mounted to said at least one wall within said compartment.

12. A mobile supply apparatus as recited the claim 11 further comprising insulation located between said housing and said reservoir and partially surrounding said reservoir; substantially no insulation positioned between said at least one wall of said compartment and said reservoir proximate said at least one wall.

13. A mobile supply apparatus as recited in claim 8 further comprising a lifting receptacle attached to said housing and adapted for engagement by a lifting mechanism for placement of said mobile supply apparatus onto a motor vehicle.

14. A mobile supply apparatus for mounting on a motor vehicle, said apparatus adapted for heating and supplying a viscous composition to a desired work site, said apparatus comprising:

(a) a housing;

(b) a reservoir inside said housing and adapted to receive a quantity of said composition therein;

(c) a wall in said housing and bordering a portion of said reservoir; and (d) a hose mounted adjacent to and in heat transfer relation to said wall for heating of said hose from said composition in said reservoir.

15. Apparatus as recited in claim 14 further comprising an access compartment disposed in said housing adjacent said reservoir, said wall (c) separating said reservoir and said access compartment.

16. Apparatus as recited in claim 15 further comprising a first heat exchanger positioned proximate said wall for heating said composition.

17. Apparatus as recited in claim 14 further comprising insulation covering said reservoir except for said portion of said reservoir bordered by said wall (c).

18. Apparatus as recited in claim 14 wherein said wall and said portion of said reservoir are contiguous to each other.

19. Apparatus as recited in claim 14 further comprising at least one lift mounting receptacle attached to said housing.

20. Apparatus as recited in claim 14 further comprising a heat exchange coil disposed in said reservoir for heating said composition in said reservoir.

* * * * *